US007140136B2

(12) United States Patent
Flynn et al.

(10) Patent No.: US 7,140,136 B2
(45) Date of Patent: Nov. 28, 2006

(54) APPARATUS AND METHOD FOR TRANSFERRING A LABEL PORTION FROM A LABEL ASSEMBLY ONTO AN OBJECT

(76) Inventors: Timothy J. Flynn, 18 Caloosa Rd., Key Largo, FL (US) 33037; Thomas E. Flynn, 7305 Gleneagle Cir., Crystal Lake, IL (US) 60014; Patrick J. Flynn, 107 Jennifer St., Redlands, CA (US) 92373

( * ) Notice: Subject to any disclaimer, the term of this patent is extended or adjusted under 35 U.S.C. 154(b) by 308 days.

(21) Appl. No.: 10/794,577

(22) Filed: Mar. 5, 2004

(65) Prior Publication Data

US 2005/0193608 A1 Sep. 8, 2005

(51) Int. Cl.
*G09F 3/10* (2006.01)

(52) U.S. Cl. ..... 40/638; 40/641; 283/81

(58) Field of Classification Search ..... 40/641, 40/638, 359; 283/81
See application file for complete search history.

(56) References Cited

U.S. PATENT DOCUMENTS 3,054,202 A * 9/1962 Scholfield ..... 40/641
3,937,493 A * 2/1976 Fasbender ..... 283/41
4,137,658 A * 2/1979 Wos ..... 40/641
4,204,639 A * 5/1980 Barber et al. ..... 235/488
4,962,603 A * 10/1990 Kao et al. ..... 40/641
5,462,783 A * 10/1995 Esselmann ..... 428/42.1
5,513,459 A 5/1996 Schneider
5,848,809 A * 12/1998 Petkovsek ..... 283/61
6,037,029 A * 3/2000 Instance ..... 428/40.1
6,086,107 A * 7/2000 Whistler et al. ..... 283/81
6,375,604 B1 * 4/2002 Verhines ..... 493/325
6,511,725 B1 * 1/2003 Rawlings ..... 428/40.1
2002/0129526 A1 * 9/2002 Sato et al. ..... 40/641

* cited by examiner

*Primary Examiner*—Gary C. Hoge
(74) *Attorney, Agent, or Firm*—Pauley Petersen & Erickson

(57) ABSTRACT

An apparatus and method for transferring a label from a label assembly onto a multi-surfaced object includes folding a first portion of the label along a first line of weakness and retaining a remaining portion of the label to the back sheet. An edge of the object is then inserted against the first line of weakness and the first portion of the label is adhered to a first surface of the object. A remaining portion of the label is then removed from the label assembly and adhered to the additional surface of the object resulting in a properly indexed, smooth application of the label to the object.

17 Claims, 2 Drawing Sheets

APPARATUS AND METHOD FOR TRANSFERRING A LABEL PORTION FROM A LABEL ASSEMBLY ONTO AN OBJECT

BACKGROUND OF THE INVENTION

This invention is directed to an apparatus and method for applying and transferring a label from a back sheet of a label assembly onto an object, particularly a multi-surfaced object such as a file folder tab.

DESCRIPTION OF RELATED ART

Labels such as those described herein can be used in connection with a wide variety of items, particularly, file folders, file folder tabs, CD jewel cases and the like. It is desirable to have a label for adhering to items that will apply straight and direct to the object without misalignment, wrinkles, bubbles, folds or other errors inherent in the application of adhesive-backed labels onto items.

In addition, labels improperly affixed to objects with adhesive can harm the object if a user attempts to remove and/or straighten the labels. More specifically, damage may be caused by pulling off and/or tearing some of the file folder material along with the label. In addition, when a traditional label is peeled from its backing, the traditional label includes an inherent curling that may manifest itself a period of time later by peeling away from the object. This peel memory is problematic with tradition peel and stick labels and particularly damaging when used in connection with file folder labels that may fall off of the relevant file.

Accordingly, a need exists for a new and improved apparatus and method for applying and transferring a label from a backing sheet of a label assembly onto a multi-surfaced object, such as a file folder tab, in an accurate and positive fashion.

SUMMARY OF THE INVENTION

A general object of the invention is to provide an improved apparatus and method for applying and transferring a label from a backing sheet of a label assembly onto a multi-surfaced object, such as a file folder tab.

A more specific object of the invention is to overcome one or more of the problems described above.

The above and other objects of the invention can be attained through an improved method and apparatus for transferring a label from a back sheet of a label assembly onto an object having multiple surfaces. The label assembly preferably includes one or more labels, each label having two or more portions divided by a line of weakness. According to one preferred embodiment of this invention, the label is folded along the one or more lines of weakness and configured to form a pocket into which the object is inserted. At least a first portion of the label is then applied to a first surface of the object and the object with the attached label is then removed from the back sheet of the label assembly. The remaining portion or portions of the label may then be applied accurately and easily on each respective surface of the object. Such method and apparatus is particularly suited to applying file folder labels to file folders and/or file folder tabs.

Other objects and advantages of the invention are apparent to those skilled in the art, in view of the following detailed description taken in conjunction with the appended claims and drawings.

BRIEF DESCRIPTION OF THE DRAWINGS

The present invention can be better understood with reference to the following drawings. In the drawings, like reference numerals designate corresponding parts throughout the several views. Moreover, it should be noted that the drawings are not necessarily to scale, emphasis instead being placed upon clearly illustrating principles of the present invention.

DETAILED DESCRIPTION OF THE INVENTION

FIGS. 1–5 illustrate a method and apparatus for applying and transferring a label, such as label 40 from back sheet 30 of label assembly 20 onto an object, according to preferred embodiments of this invention. According to various preferred embodiments of this invention, the subject method and apparatus is particularly suitable for applying and transferring label 40 from label assembly 20 to a multi-surface object 120, such as a file folder tab or a file folder. Such file folder tabs are disclosed in U.S. Pat. No. 5,513,459, the disclosure of which is incorporated herein by reference.

Figure 1:
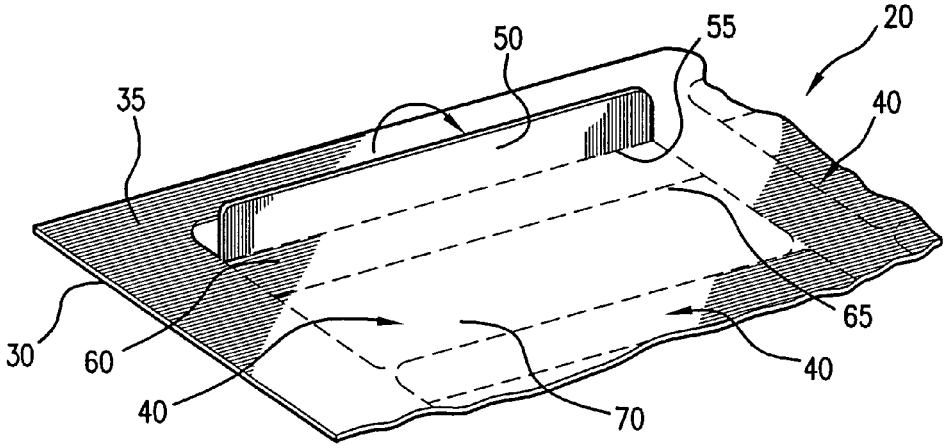
FIG. 1 shows a top perspective view of a folded first portion of a label assembly according to one preferred embodiment of this invention.
Figure 2:
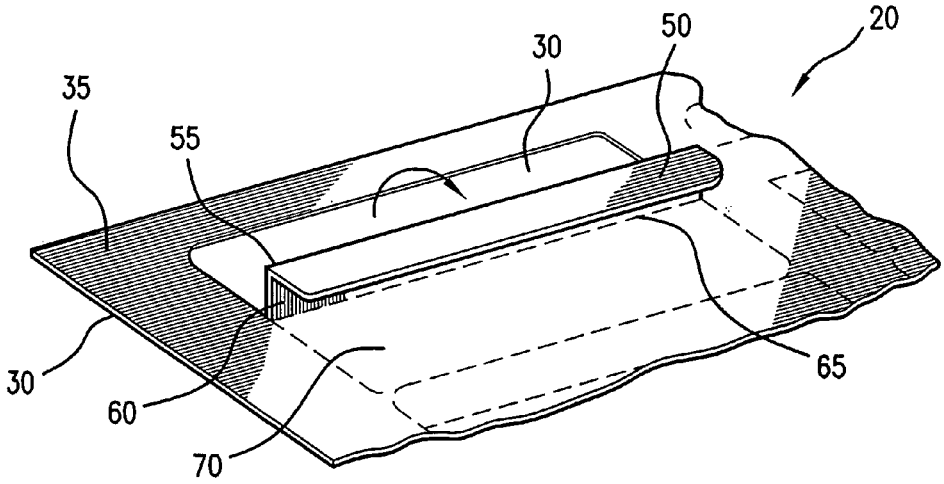
FIG. 2 shows a top perspective view of a folded second portion of the label assembly shown in FIG. 1.
Figure 3:
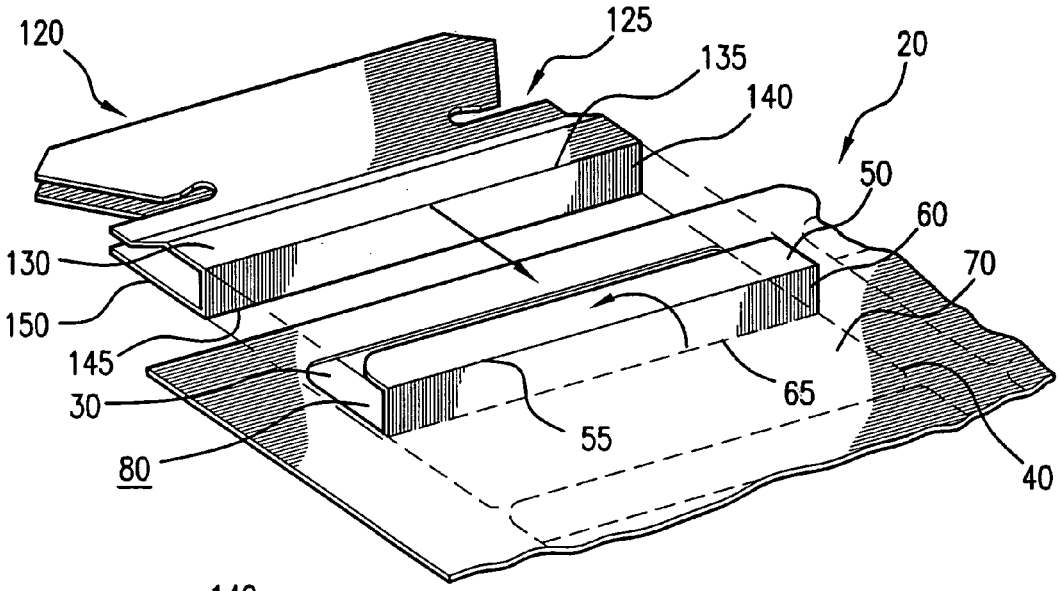
FIG. 3 shows a top perspective view of insertion of an object into the label assembly shown in FIG. 1.

Referring generally to FIGS. 1–3, label assembly 20 is of any suitable shape, and generally any suitable size that can be accepted by and fed through a printer, such as a laser printer or an inkjet printer. Common sizes of paper generally fed through printers are 8.5 inches by 5.5 inches, 8.5 inches by 11 inches, 8.263 inches by 11.688 inches (A4 size), and 8.5 inches by 14 inches. Label assembly 20 preferably comprises face sheet 35 and back sheet 30 with a layer of adhesive between. Similar label assemblies, for varied but overlapping applications, are disclosed in copending, commonly-owned U.S. patent application Ser. No. 10/243,481 having a filing date of 25 Apr. 2003, the disclosure of which is incorporated herein by reference.

Face sheet 35 is preferably but not necessarily constructed of any suitable paper, paper composite, non-metal and/or metal material that can be used as a label. Other suitable materials for constructing label assembly 20 include fabric, plastic, and metal foils. An adhesive coating is applied, in any suitable manner known to those skilled in the art, to one side of face sheet 35. Face sheet 35 preferably has a printable surface on a side opposite the adhesive side. The printable surface on face sheet 35 can be any of a variety of face materials used to make pressure sensitive, or self-adhesive labels. Such face materials may include, but are not limited to, smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Further, various portions of the face materials can be different colors, thereby resulting in different colored parts, such as label 40, as described in greater detail below.

As used throughout this specification and/or in the claims, the term "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Prior to assembling, label assembly 20 can be fed into and run through a printer for labeling and/or decorating any portion. Label assembly 20 therefore includes at least one printable side for accepting printing, such as descriptive and/or decorative material.

Figure 4:
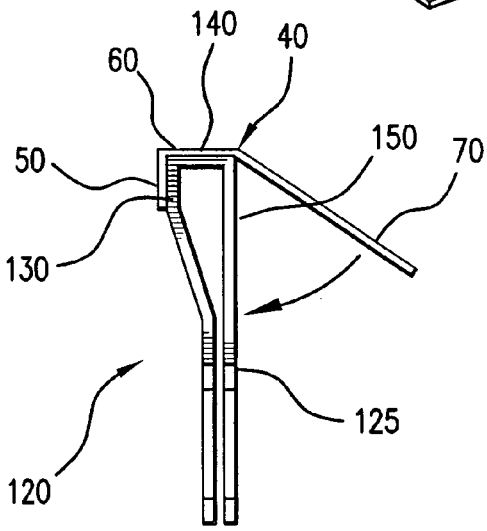
FIG. 4 shows a side view of adhesion of a label from the label assembly of FIG. 1.
Figure 5:
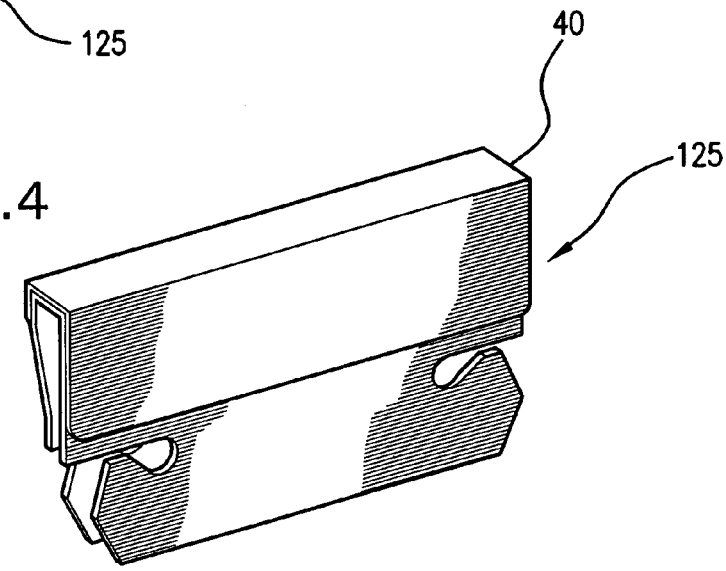
FIG. 5 shows a front perspective view of a label from the label assembly of FIG. 1 as applied to an object.

One common practice for printing a label/label assembly 20 as described herein would include a file description such as a file name, a docket number, a color, numerical and/or alphabetical code, symbols and/or any other description for organizing and referencing a file, such as a file folder or expandable file. Label 40 may be placed directly on the file folder or expandable file. Alternatively, a file folder tab 125 with label 40, such as shown in FIGS. 3–5, may be used in connection with the file folder or expandable file.

In one preferred embodiment of this invention, label assembly 20 comprises face sheet 35 having label 40 removable with respect to back sheet 30, as shown in FIGS. 1–3. Label 40 is preferably pre-cut or shaped into a desired form for application in a desired manner. As shown in FIGS. 1–3, label 40 is preferably generally rectangular but may be configured in any shaped suitable to a particular application. Label 40 is preferably die cut within face sheet 35 and formed with one or more lines of weakness 55, 65. Lines of weakness 55, 65 are preferably scored, die-cut, perforated, acid etched or similar weakness formed within the parameters of label 40 so as to urge one portion of label 40 to fold relative to another portion of label 40 when label 40 is removed or partially removed from back sheet 30.

Back sheet 30 of label assembly 20 preferably includes one side having a treated surface to facilitate removal of back sheet 30 relative to face sheet 35. Therefore, at least one side of back sheet 30 preferably includes a smooth and/or waxy surface to ease separation from the adhesive side of face sheet 35. The side opposite the treated surface of back sheet 30 may be a printable surface or any other suitable surface.

As described, an improved method for transferring label 40 from back sheet 30 of label assembly 20 onto object 120, such as file folder tab 125, having multiple surfaces 130, 140 and/or 150 may include folding first portion 50 of label 40 along first line of weakness 55, such as shown in FIG. 1. As shown, first portion 50 is folded at an angle relative to a remaining portion of label 40 which remains adhered to back sheet 30. Preferably, first portion 50 is folded generally at a right angle relative to the remaining portion of label 40.

According to one preferred embodiment of this invention, and as shown in FIG. 2, second portion 60 of label 40 is then folded along second line of weakness 65. A remaining portion, or third portion 70, of label 40 is then retained to back sheet 30. As shown in FIGS. 2 and 3, second portion 60 of label 40 is configured into a generally perpendicular position relative to first portion 50 and second portion 60. First portion 50 is then positioned generally parallel to third portion 70 as shown in FIG. 3. As a result, pocket 80 is formed by first portion 50, second portion 60 and back sheet 30 of label assembly 20.

FIG. 3, demonstrates insertion of object 120, such as file folder tab 125, into the preferred configuration, or pocket 80, of label assembly 40. As shown and described, object 120 preferably includes two or more surfaces, such as first surface 130, second surface 140 and third surface 150, as shown in FIGS. 3–5.

Accordingly, first, second and third portions 50, 60, 70 of label 40 are preferably contiguous surfaces on label 40 prior to application and, subsequent to application are positioned in at least two different planes. Preferably, though not necessarily, third portion 70 includes a larger surface area than first portion 50 or second portion 60.

According to a preferred method of this invention, an edge, such as an upper edge 135, of object 120 is placed against first line of weakness 55. In addition, another edge, such as lower edge 145, of object 120 is placed against second line of weakness 65, thereby properly indexing object 120 relative to label 40. Further, because back sheet 30 is preferably non-adhesive, and even glossy, object 120 may be inserted into pocket 80 without adhering to additional or undesirable portions of label assembly 20.

Accordingly, first portion 50 of label 40 is then adhered to first surface 130 of object 120. In addition, second portion 60 of object 120 is preferably adhered to second surface 140 of object 120. First surface 130 and second surface 140 are preferably, though not necessarily, located in different planes on object 120.

A remaining portion of label 40 is then removed from label assembly as shown in FIG. 4. Such remaining portion, such as third portion 70 may then be properly and accurately applied and adhered to object 120. As a result, label 40 requiring adhesion to multiple surfaces may be properly indexed and accurately placed on object 120 without misalignment, bubbles, folds or similar mistakes.

According to one preferred embodiment of this invention, face sheet 35 may be coated with a striped adhesive or an otherwise intermittent, alternating and/or irregular adhesive coating. Such an adhesive coating may minimize sticking to fingers along areas of label 40 that are peeled back prior to application to object 120. As such, when first portion 50, for instance, is peeled upward at first line of weakness 55, a small area of the underside of first portion 50, such as the corners, may be non-adhesive to facilitate the release of fingers and the subsequent removal of the remaining portion of label 20 from back sheet 30.

As described and as shown in FIGS. 3–5, object 120 may comprise file folder tab 125 and label 40 may comprise a file folder label. The file folder label may include a color code on upwardly facing, second portion 60 of label 40 and a file code and/or docket number and/or file name on first portion 50 and/or third portion 70 of label 40.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

We claim:

1. An improved method for transferring a label from a back sheet of a label assembly onto an object having multiple surfaces, the improvement comprising the steps of:

folding a first portion of the label along a first line of weakness;

retaining a remaining portion of the label to the back sheet;

inserting an edge of the object against the first line of weakness;

adhering the first portion of the label to a first surface of the object;

removing the remaining portion of the label from the label assembly; and adhering the remaining portion of the label to an additional surface of the object.

2. The method of claim 1 further comprising the steps of:

folding a second portion of the label along a second line of weakness;

inserting another edge of the object against the second line of weakness; and adhering the second portion of the label to a second surface of the object.

3. The method of claim 1 further comprising the step of:

folding the first portion of the label along a perforation.

4. The method of claim 1 further comprising the step of:

folding the first portion generally at a right angle relative to the remaining portion of the label.

5. The method of claim 1 further comprising the step of:

coating an underside of the label with a striped adhesive.

6. The method of claim 1 further comprising the step of:

scoring the label to create the first line of weakness.

7. An improved method for transferring a label from a back sheet of a label assembly onto an object having multiple surfaces, the label having a first portion, a second portion and a third portion, each for adhesion to a different surface of the multiple surfaces, the improvement comprising the steps of:

folding the first portion of the label along a first line of weakness;

folding the second portion of the label along a second line of weakness while retaining the third portion of the label to the back sheet;

configuring the second portion of the label generally perpendicular to the first portion and the second portion;

configuring the first portion of the label generally parallel to the third portion;

inserting the object adjacent to each of the first line of weakness and the second line of weakness;

adhering the first portion of the label to a first surface of the object and the second portion of the label to a second surface of the object;

removing the third portion of the label from the label assembly; and adhering the third portion of the label to a third surface of the object.

8. The method of claim 7 further comprising the step of:

folding the first portion of the label along a perforation.

9. The method of claim 7 further comprising the step of:

coating an underside of the label with a striped adhesive.

10. The method of claim 7 further comprising the step of:

scoring the label to create the first line of weakness.

11. The method of claim 7, further comprising the step of:

configuring the label so that the first portion of the label and the second portion of the label each include a smaller surface area than the third portion of the label.

12. An improved method for transferring a label from a back sheet of a label assembly onto an object having multiple surfaces, the label having a first portion, a second portion and a third portion, each for adhesion to a different surface of the multiple surfaces, the improvement comprising the steps of:

folding the first portion of the label along a first line of weakness;

folding the second portion of the label along a second line of weakness while retaining the third portion of the label to the back sheet;

configuring the first portion and the second portion of the label to form a pocket above the back sheet of the label assembly;

inserting the object into the pocket;

adhering the first portion of the label to a first surface of the object and the second portion of the label to a second surface of the object;

removing the third portion of the label from the label assembly; and adhering the third portion of the label to a third surface of the object.

13. The method of claim 12, further comprising the step of:

coating a backside of the label with an intermittent adhesive coating.

14. The method of claim 12, further comprising the step of:

adhering the label to a file folder tab having three surfaces.

15. The method of claim 12, further comprising the step of:

adhering the label to a file folder having two surfaces.

16. The method of claim 12, further comprising the step of:

configuring the label so that the first portion of the label and the second portion of the label each include a smaller surface area than the third portion of the label.

17. The method of claim 12, further comprising the step of:

printing the label so that the first portion and the third portion include text and the second portion includes a color.

* * * * *